United States Patent [19]

Koutzaroff

[11] Patent Number: 4,791,763

[45] Date of Patent: Dec. 20, 1988

[54] PANEL SYSTEM FOR A CLEAN ROOM

[76] Inventor: Constantin Koutzaroff, 31, avenue de la Marne, 06100 Nice, France

[21] Appl. No.: 81,483

[22] Filed: Aug. 4, 1987

[30] Foreign Application Priority Data

Nov. 7, 1986 [FR] France ..... 86 15650

[51] Int. Cl.[4] ..... E04C 2/42

[52] U.S. Cl. ..... 52/180; 52/581; 52/660; 52/262; 55/385.2

[58] Field of Search ..... 15/215, 660, 664; 52/179, 666, 180, 181, 177, 581, 262; 98/31.6, 34.6; 55/385 A

[56] References Cited

U.S. PATENT DOCUMENTS

| | | | |
|---|---|---|---|
| 1,544,914 | 7/1925 | Larsen | 15/215 |
| 3,862,464 | 1/1975 | Arens | 52/664 |
| 3,986,850 | 10/1976 | Wilcox | 55/385 A |
| 4,135,339 | 1/1979 | Pawlitschek | 52/660 |
| 4,244,768 | 1/1981 | Wiechowski | 52/180 |
| 4,320,719 | 3/1982 | Clemmensen | 52/660 |
| 4,484,250 | 11/1984 | Rzepecki | 15/215 |
| 4,516,377 | 5/1985 | Feller | 52/660 |
| 4,628,662 | 12/1986 | Nooyen | 52/660 |
| 4,712,340 | 12/1987 | Sogge | 52/180 |

FOREIGN PATENT DOCUMENTS

| | | | |
|---|---|---|---|
| 24354 | 3/1914 | Norway | 15/215 |

*Primary Examiner*—John E. Murtagh

*Attorney, Agent, or Firm*—Cooper & Dunham

[57] ABSTRACT

A panel for a raised floor of a clean room, such as for a semiconductor manufacturing facility, comprises tubes (2) whose open ends (3) are slipped over respective spacers (4) of spacer bars (5), providing cross-connection and support for said tubes (2). No welding or adhesives are needed. The size of the panel can be conveniently changed or adapted in the plant or in the field.

20 Claims, 4 Drawing Sheets

PANEL SYSTEM FOR A CLEAN ROOM

BACKGROUND AND SUMMARY OF THE INVENTION

The invention pertains to raised floor panels used for clean rooms and the like.

Clean rooms are used mainly in semiconductor device manufacturing facilities to improve yield by reducing contamination due to causes such as airborne particles. The maximum particle count permissible in such clean rooms must meet very exacting requirements, and much effort is devoted to that end, including the use of a highly filtered airflow through the room and the use of a pressure differential between the room and the ambient. Typicall, filtered air enters the room through ceiling registers and exits through perforated floor panels forming a part of a raised (double) floor. The panels sit on adjustable height posts. The floor typically uses some perforated and some solid panels. Dampers or some other means can be used to regulate air flow. For example, a perforated panel can use a double layer of perforated sheet, and a movable register can be mounted between the two sheets to regulate airflow. The panels can comprise a metal pipe frame welded at the corners, on top of which is also welded, e.g. tack welded, a perforated metal sheet. Inside the frame, parallel to two of its sides, rectangular or L-shape cross bars are welded at their end to the other two sides and to the perforated sheet metal above.

One disadvantage of such raised floors is that once the panels are fabricated it is not convenient to change their size in the field if needed to fit a particular clean room. Another disadvantage is that the steel frame can rust and the covering can collect dirt, increasing the risk that the particle count in the clean room may exceed the permissible limit. Yet another disadvantage is that typically the airflow openings of such perforated panels comprise only about a quarter of the panel area.

In contrast, the invention provides panels which can be conveniently changed in size in the field, significantly reduce the risk of adverse effects on particle count, and can provide higher airflow per unit floor area. In one exemplary embodiment a panel in accordance with the invention comprises stainless steel tubes cut from tube stock, and a pair of spaced-apart, parallel spacer bars. Each spacer bar has a row of spacers facing the other spacer bar. One open end of a tube is slipped over a spacer of one spacer bar and the other open end of the same tube is slipped over the opposite spacer of the other spacer bar. No welding or adhesives are requried, and the size of a panel can be conveniently changed in the field by cutting different length tubes from tube stock, or by cutting parts or pre-cut tubes to make up a smaller panel. The spacer bars similarly can be cut in the field to reduce the other dimension of the panel. To facilitate assembly of a panel, the spacers can have chamfered guiding edges which make it easier to slip the open end of a tube over a spacer. To facilitate assembly of the panels into a raised floor, the longitudinal ends of the spacer bars have interlocks which secure the panels to each other. The bottom runs of the spacer bars have provisions for supporting movable registers (dampers) for regulating airflow, for example an L-shaped support flange on each spacer bar or a channel in the spacer bar. The tubes can be stainless steel or can be made of a carbon fiber material (electrically conductive). They can be round, or of rectangular cross section, or of some other cross section. The spacer bars can be made of a molded plastic material, preferably an electrically conductive material (for example a plastic material containing conductive fibers). The electrically conductive tubes and spacer bars are electrically grounded to reduce the chance that static electricity would adversely affect particle count.

Panels embodying the invention can be assembled conveniently in any size in the field or in the plant, show highly improved resistance to deterioration over time or due to corrosive chemicals and high airflow per unit area, lower the danger of contamination due to increased particle count, and can be conveniently replaced or reused as needed.

DETAILED DESCRIPTION

Figure 1:
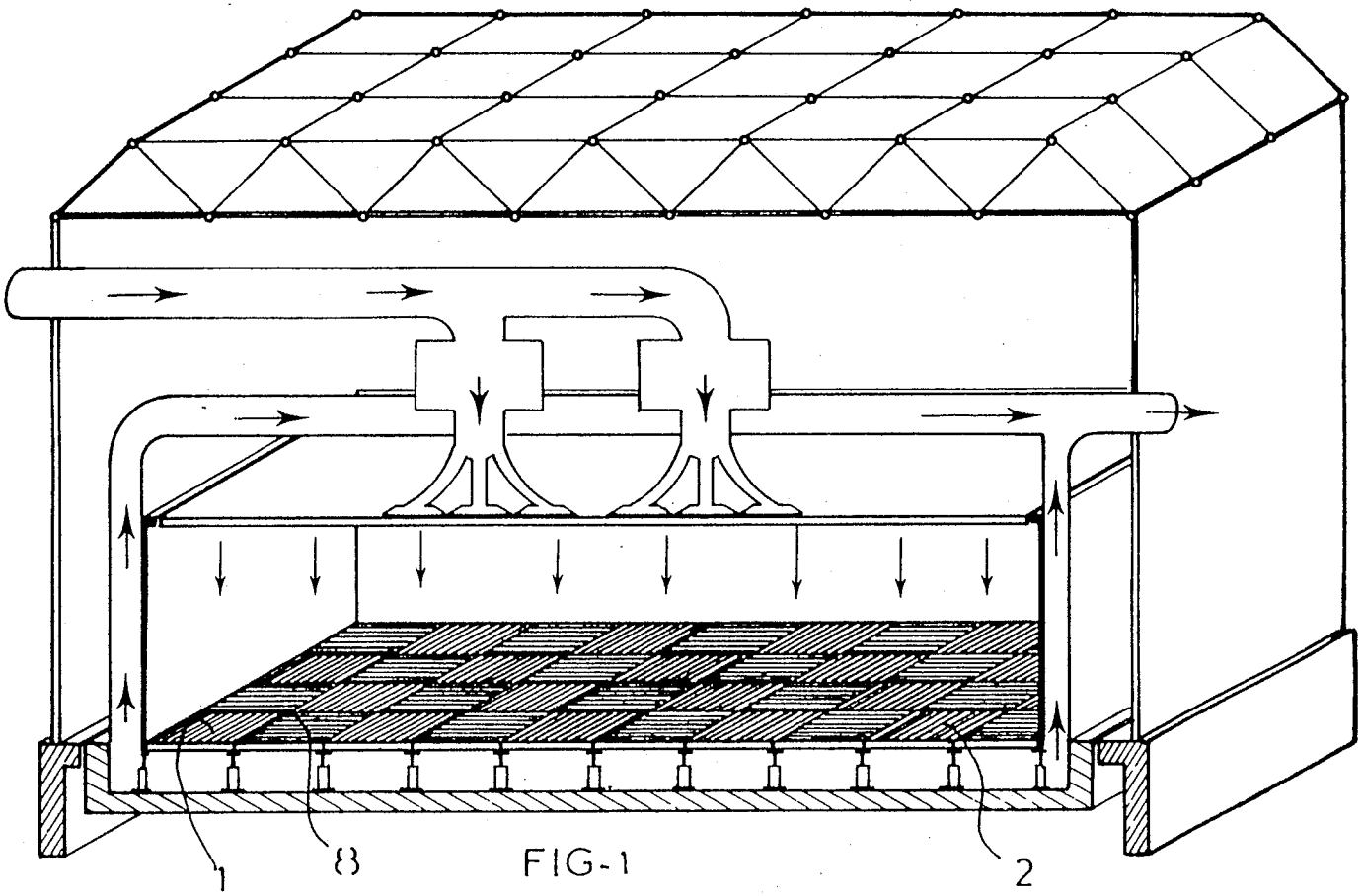
FIG. 1 is a partly perspective and partly sectional view of a clean room using a raised (double) floor.
Figure 2:
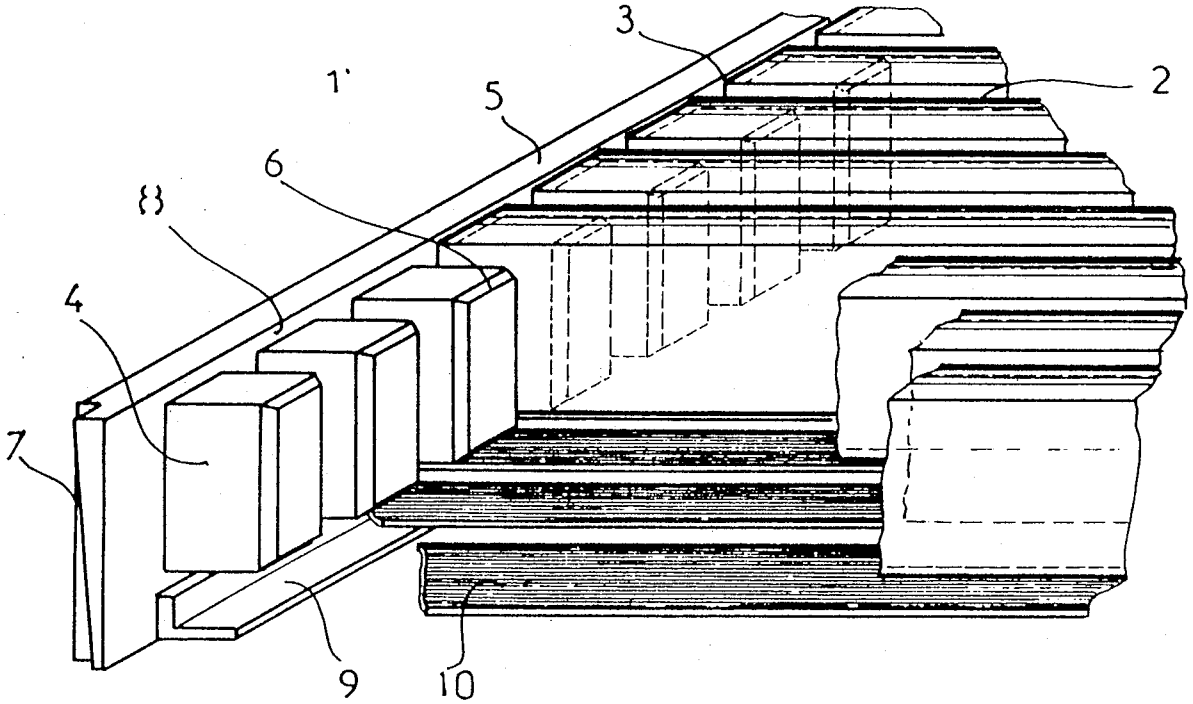
FIG. 2 is a partly perspective and partly cut-away view of a part of a panel in accordance with the invention, showing the mounting of tubes onto spacers of a spacer bar and of an airflow regulating register.
Figure 3:
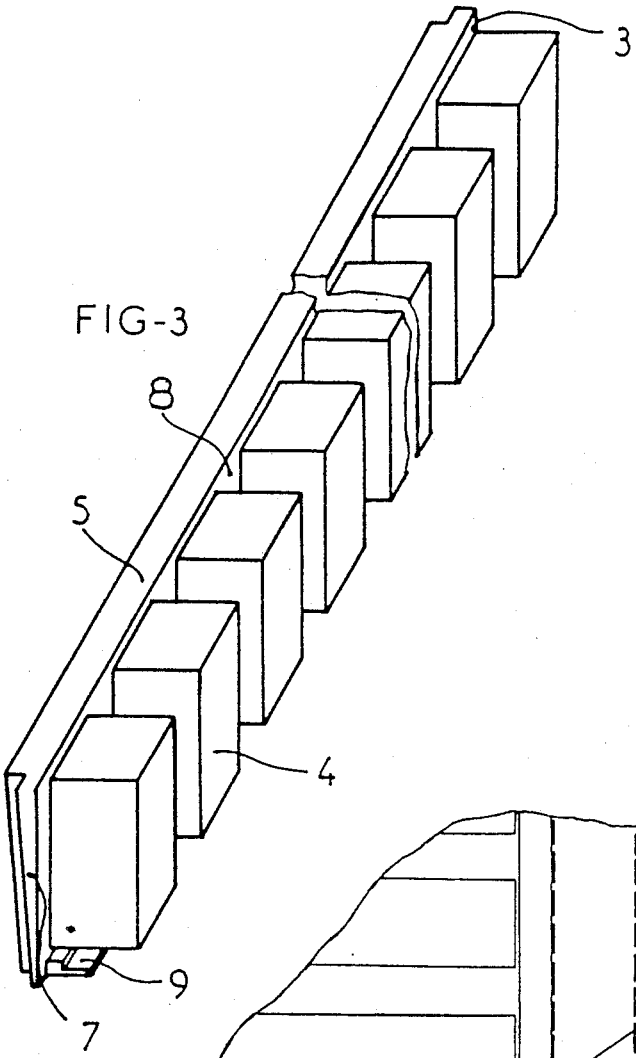
FIG. 3 is a perspective view of a spacer bar.
Figure 4:
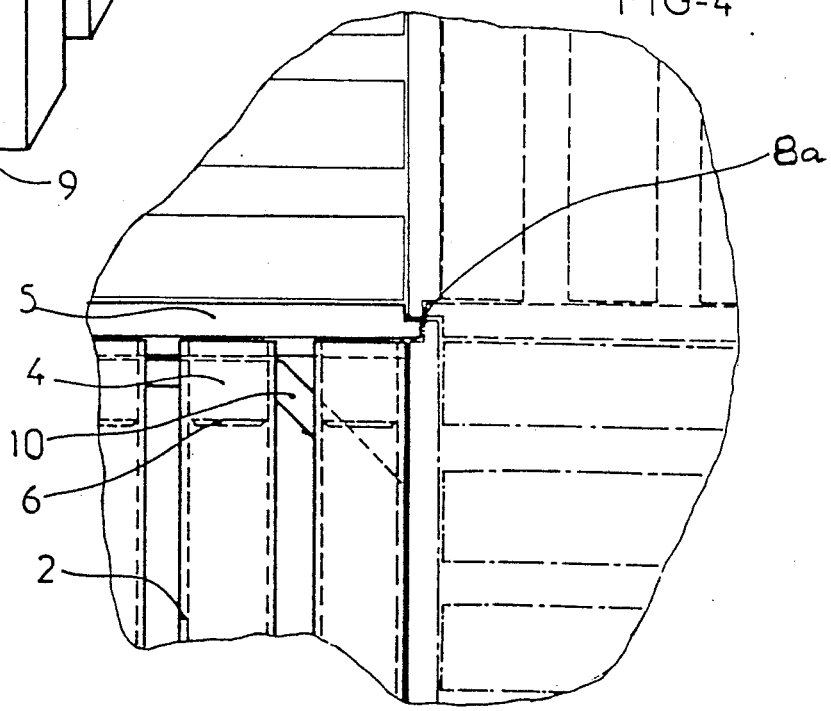
FIG. 4 is a top plan view showing the installation of panels with interlocked longitudinal ends of the spacer bars.
Figure 5:
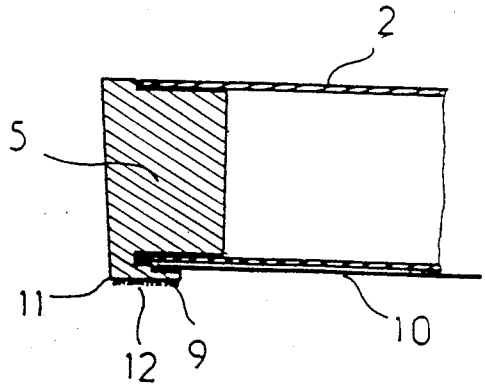
FIG. 5 is a cross-sectional view of a spacer bar, a spacer, a tube slipped thereon and a register blade.
Figure 6:
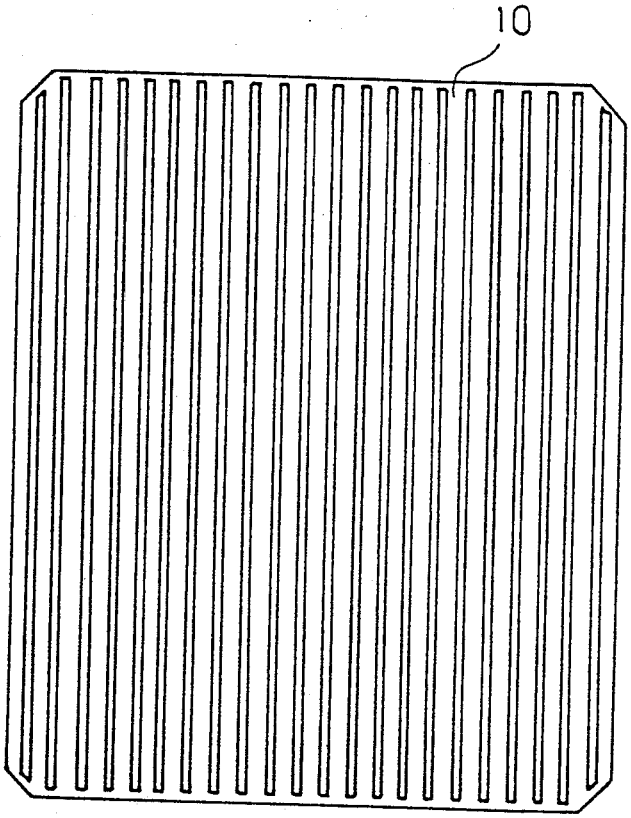
FIG. 6 is a plan view of a register.

A panel 1 for a raised floor of a clean room comprises tubes 2 which have open ends 3. Tubes 2 preferably are made of stainless steel but can be made of other materials, such as carbon fiber materials which are electrically conductive. Tubes 2 are supported at their ends 3, which are slipped over spacers 4 arranged in rows along the lengths of respective spacer bars 5. Spacer bars 5 can be made of a plastic material, such as a material which can be molded into the required shape and preferably is electrically conductive. Spacers 4 can have chamfered guiding edges 6 to facilitate the slipping of an open end 3 of a tube 2 over a spacer 4.

Spacer bars 5 have interlocks 7 at their longitudinal ends. The interlocks 7 allow the panels to interlock securely when assembled into a raised floor by forming cross connections 8*a*. Panels 1 are assembled into a raised floor such that tubes 2 of one panel 1 are oriented perpendicularly to those of the adjacent panels 1. In such an arrangement, interlocks 7 serve as positioning corners or panel 1.

Each spacer bar 5 carries on its interior face 8, under spacers 4, a flange 9 which serves as a support for an airflow regulating register 10 which can be installed as a part of a panel 1. Flange 9 can be attached to the spacer bar 5 or groove-formed into the profile of the spacer bar 5 itself.

The bottom face 11 of each spacer bar 5 can carry an attaching device for securing the panels 1 to the adjustable floor support posts illustrated at FIG. 1, and/or a layer 12 of slip-proof material.

I claim:

1. A panel for a raised floor of a clean room comprising a pair of spaced apart, elongated spacer bars each having a row of spacers facing the other spacer bar, open ended tubes each having one end slipped over a spacer of one spacer bar and the other end slipped over a corresponding spacer of the other spacer bar, wherein the tubes are spaced from each other to allow airflow through the panel, each spacer bar further having an interlock at its longitudinal ends for interlocking with interlocks of other such panels when the panels are assembled into a raised floor comprising a plurality of adjacent panels where the bars of one panel are perpendicular to those of adjacent panels, and each spacer bar further having a flange beneath the spacers for supporting an airflow regulating register.

2. A panel for a raised floor of a clean room as in claim 1 in which the tubes are made of stainless steel.

3. A panel for a raised floor of a clean room as in claim 1 in which the tubes are cut from stainless steel tube stock.

4. A panel for a raised floor of a clean room as in claim 1 in which the tubes are made of a carbon fiber material.

5. A panel for a raised floor of a clean room as in claim 1 in which the spacer bars are made of an electrically conductive plastic material.

6. A panel for a raised floor of a clean room as in claim 1 in which the spacer bars are made of a molded, electrically conductive plastic material.

7. A panel for a raised floor of a clean room as in claim 1 in which the spacers have chamfered guiding edges to facilitate slipping said open ends of the tubes over the spacers.

8. A panel for a raised floor of a clean room as in claim 1 in which tubes slipped over the spacers are not secured thereto by welding or adhesives.

9. A panel for raised floor, mainly for clean rooms, characterized by the fact that the panel is formed of tubes (2) open at their ends (3) and supported at said open ends (3) by spacer bars (5).

10. A panel as in claim 9 characterized by the fact that the tubes (2) are supported at their ends (3) which are slipped over spacers (4) positioned along the spacer bars (5).

11. A panel as in claim 10, characterized by the fact that the spacers (4) have chamfered guiding edges (6) which facilitate slipping tubes (2) at their open ends (3) over the spacers (4).

12. A panel as in claim 11, characterized by the fact that the spacer bars (5) have interlocks (7) at their longitudinal ends.

13. A panel as in claim 12, characterized by the fact that the interlocks (7) allow the panel to interlock with other panels at a cross connection (8*a*) when the panels (1) are installed with the tubes (2) of each panel oriented perpendicularly to those of the adjacent panels.

14. A panel as in claim 13, characterized by the fact that the interlocks (7) form positioning corners.

15. A panel as in claim 14, characterized by the fact that the spacer bars (5) have on their interior face (8), under the spacers (4), guiding means (9) which can serve as a support for a register (10).

16. A panel as in claim 9, characterized by the fact that the tubes (2) are of stainless steel.

17. A panel as in claim 9, characterized by the fact that the tubes (2) are of carbon fiber material.

18. A panel as in claim 9, characterized by the fact that the bottom fact (11) of each spacer bar (5) has at least one of an attaching device and a slip-proof surface.

19. A pluarlity of panels arranged into a raised floor of a clean room, wherein each panel comprises a pair of spaced apart, elongated spacer bars each having a row of spacers facing the other spacer bar, open ended tubes each having one end slipped over a spacer of one spacer bar and the other end slipped over a corresponding spacer of the other spacer bar, wherein the tubes are spaced from each other to allow airflow through the panel, each spacer bar further having an interlock at its longitudinal ends and wherein the panels assembled into said raised floor interlock with each other when the tubes of one panel are perpendicular to those of adjacent panels.

20. A plurality of panels as in claim 19 in which the tubes of each panel are made of one of (i) stainless steel and (ii) a carbon fiber material, and the spacer bars are made of a molded, electrically conductive plastic material.

* * * * *